US006834745B2

(12) United States Patent
Vandelinde

(10) Patent No.: US 6,834,745 B2
(45) Date of Patent: Dec. 28, 2004

(54) ANCHORING DEVICE

(75) Inventor: Henry Vandelinde, Queensville (CA)

(73) Assignee: Winsafe Corp., Markham (CA)

( * ) Notice: Subject to any disclaimer, the term of this patent is extended or adjusted under 35 U.S.C. 154(b) by 0 days.

(21) Appl. No.: 10/271,735

(22) Filed: Oct. 17, 2002

(65) Prior Publication Data

US 2004/0074695 A1 Apr. 22, 2004

(51) Int. Cl.[7] ..... A62B 1/00
(52) U.S. Cl. ..... 182/3
(58) Field of Search ..... 182/3, 45; 248/499, 248/500; 410/101; 249/925

(56) References Cited

U.S. PATENT DOCUMENTS

| | | | | |
|---|---|---|---|---|
| 3,263,629 A | * | 8/1966 | HIguchi | 410/105 |
| 3,749,438 A | | 7/1973 | Loomis et al. | |
| 2004/0035992 A1 | * | 2/2004 | Watts | 248/231.9 |

FOREIGN PATENT DOCUMENTS

| | | |
|---|---|---|
| FR | 2803341 | 7/2001 |
| GB | 1280675 | 10/1970 |
| GB | 2275503 | 8/1994 |
| WO | WO 99/64110 | 12/1999 |

* cited by examiner

*Primary Examiner*—Alvin Chin-Shue
(74) *Attorney, Agent, or Firm*—Arne I. Fors

(57) ABSTRACT

An anchoring device for use in combination with personnel securing assemblies. The anchoring device is adapted for engagement within a receptacle sized to releasably receive said device. The anchoring device comprises a housing receivable within said receptacle, a pair of opposed locking jaws mounted within said housing and anchoring means secured to said housing. Pivotally connected to said housing are means for releasably extending and retracting said locking jaws into engagement with said receptacle. The locking jaws are operative to engage the receptacle in releasable locking engagement therewith. The anchoring means are functional to have personnel securing assemblies releasably connected thereto.

3 Claims, 4 Drawing Sheets

ANCHORING DEVICE

FIELD OF THE INVENTION

The invention relates to an anchoring device to which personnel safety lines may be attached. The anchoring device is particularly adapted for use with the fixed castings or receptacles commonly found on cargo containers and the decks of ships. More specifically, the anchoring device is releasably secured within the casting.

DESCRIPTION OF THE RELATED ART

The shipping and transportation of cargo in containerized units is a common world wide practice, the containers being loaded and unloaded onto ships, trucks, railway cars and the like.

Typically, each container is provided at each corner with top and/or side casting or female receptacles to enable the container to be lifted using a lifting beam or spreader having twist locks or a mechanical equivalent at each of the four corners. The twist locks have male connections which are lowered or inserted sideways into engagement with the comer castings. An exemplary twist lock is described in U.S. Pat. No. 3,749,438 to Loomis et al. This patent also provides useful background information on the art of handling cargo containers in general. Furthermore, such castings are also usually provided on the decks of container ships in order to facilitate container handling.

The heights of stacked containers, either in the ship's hold or decks or on dry land, are dangerous for personnel moving on stacked containers or working on decks. In bad weather there exists a need to provide a personnel safety anchor to which a life line may be secured. This anchor, preferably, would be secured to the container or deck mechanically and provide means for securing a shock-absorbing lanyard or retractable safety line releasably thereto. In turn such a safety line would be attached to a full body harness worn by the individual. A search of the prior art failed to locate a releasably secured anchoring device whereby the personnel could, when harnessed to a lifeline, be free to safely move about on containers, decks or the like.

SUMMARY OF THE INVENTION

It is a primary objective of the present invention to provide an anchoring device which is adapted for insertion and removal into and from the top and side openings of corner castings on the roof or sides of a container or on a ship's deck. The anchoring device is designed to be used in conjunction with a shock-absorbing lanyard or self-retracting lifeline which is attached to a personal safety harness fitted on the individual.

Broadly stated the invention comprises an anchoring device adapted to be utilized in combination with means for securing personnel to said anchoring device, said anchoring device further being adapted to be releasably secured within a receptacle sized to receive said anchoring device which comprises: a housing sized to be received within said receptacle; means for releasably securing said housing within said receptacle; and means associated with said housing for connecting said personnel securing means thereto.

Advantageously, as a result of this invention there is provided a portable anchoring device which is functional to automatically lock into the steel corner castings of shipping containers or the castings formed on the decks of container ships. Furthermore, the anchoring device is easily released from the locked position within the casting by simple depression of an actuator provided thereon.

BRIEF DESCRIPTION OF THE DRAWINGS

The anchoring device of invention will now be described with reference to the accompanying drawings, in which.

DESCRIPTION OF THE PREFERRED EMBODIMENT

Figure 1:
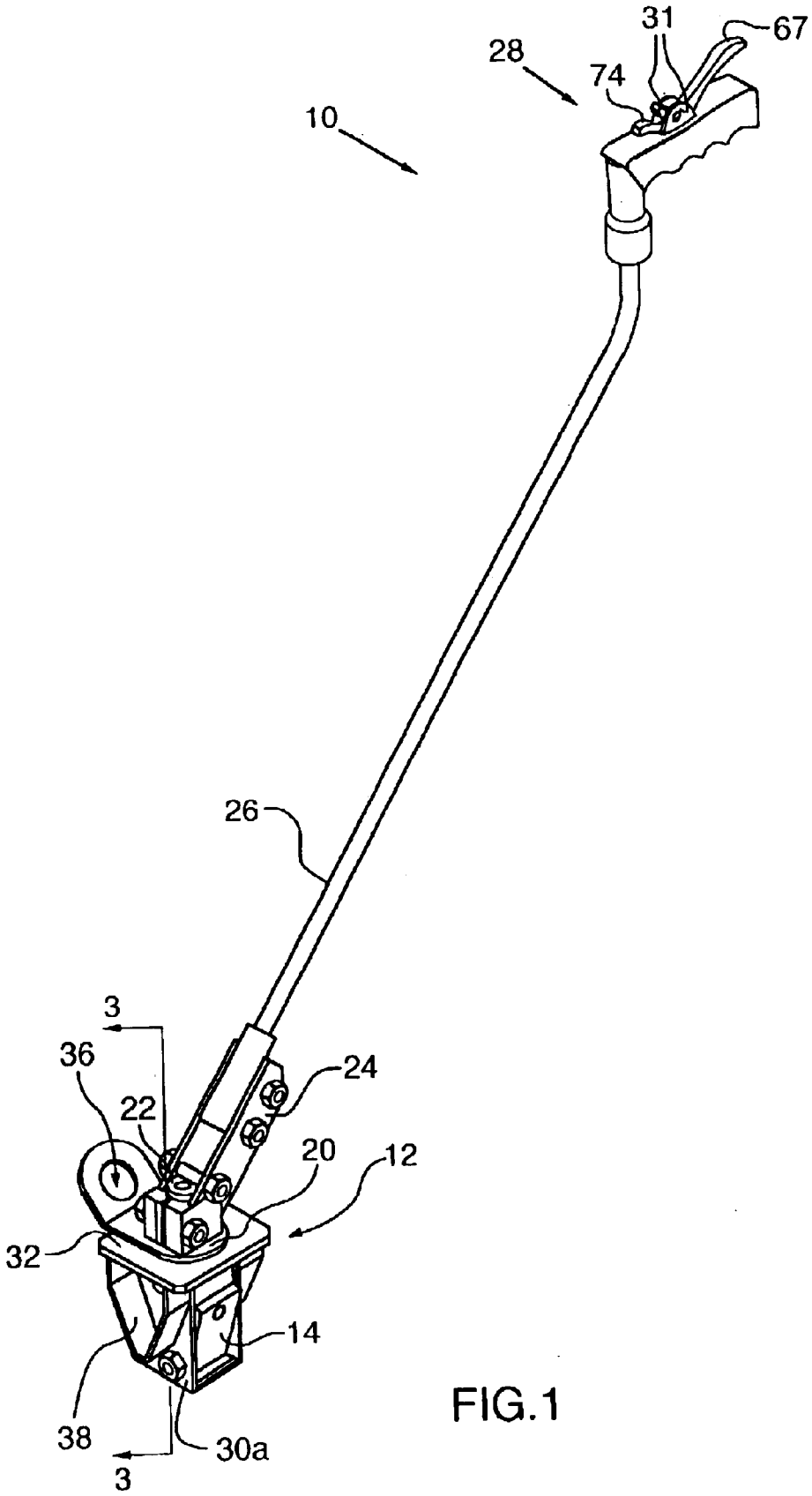
FIG. 1 is a perspective view of the anchoring device of the present invention.

The invention can be anchored to the top or side openings of a container or ship. For purposes of clarity, the description focuses on the upright orientation of the invention. Having reference to the accompanying drawings, the anchoring device 10 of the present invention comprises a housing 12 provided with a pair of locking jaws 14 functional to releasably secure the anchoring device 10 within the cavity 11 of castings 16 set in the top corners or side walls of a cargo-carrying container 18, or ship's deck, or the like. Mounted on the top of the housing 12 is an anchor plate 20 to which may be releasably attached the lanyard or lifeline 80. Above the anchor plate 20 extends a pivot pin 22 to which is operatively connected a handle socket 24 adapted to receive an elongated shaft 26, said shaft 26 being provided at its upper and distal end with a handle assembly generally designated 28 which is functional to actuate the locking jaws.

Figure 4:
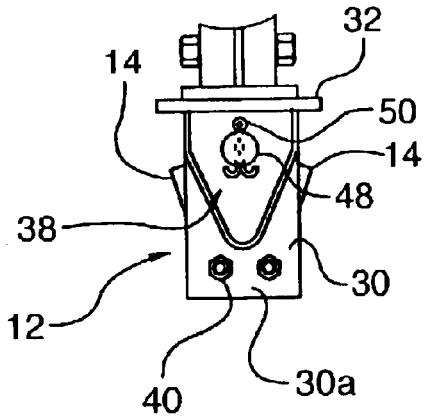
FIG. 4 is an end elevation of the housing and pivot pin of the anchoring device of FIG. 1.
Figure 3:
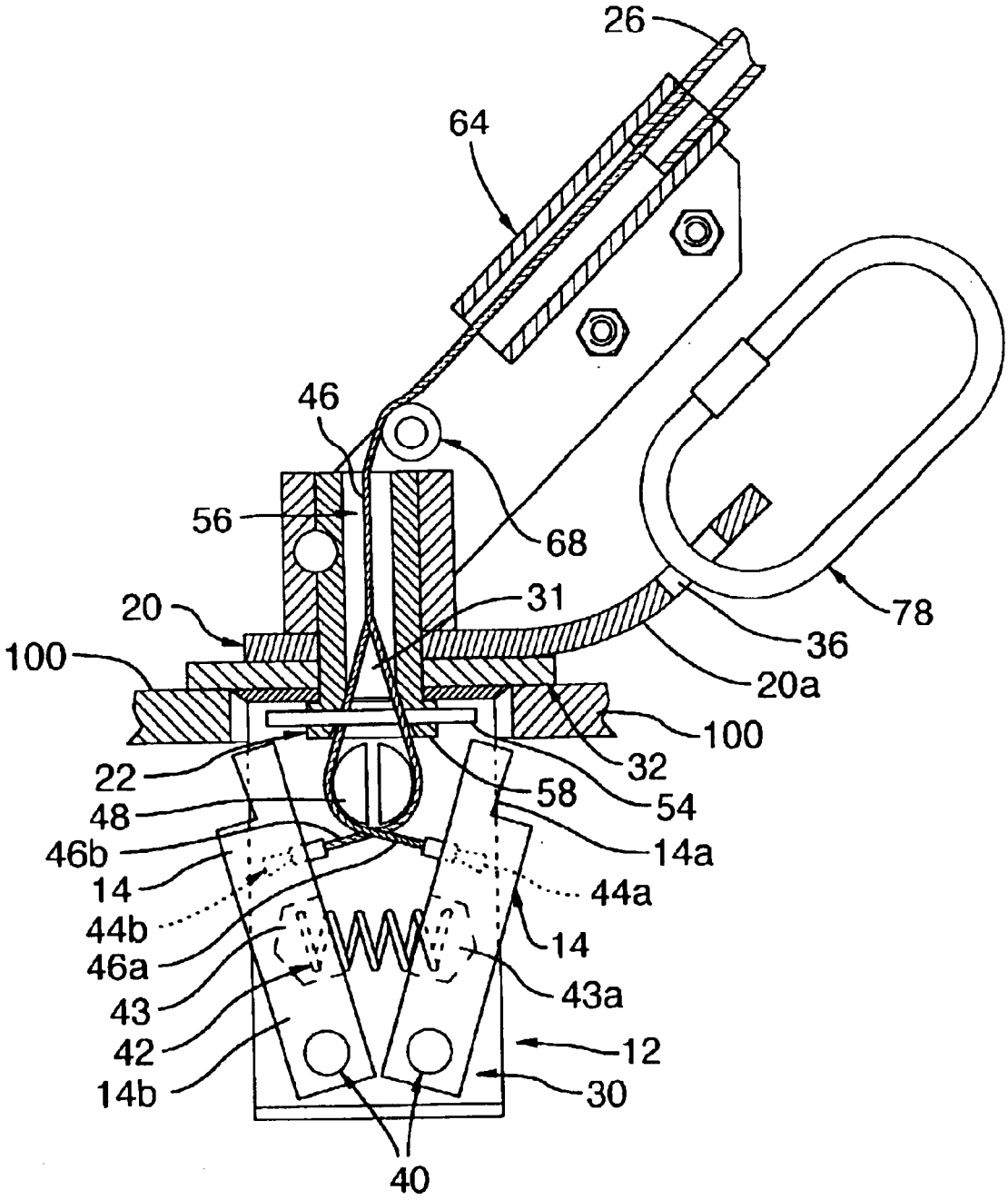
FIG. 3 is a sectional view of the housing and handle socket of the anchoring device, partly in elevation, taken through line 3—3 of FIG. 1.

Having particular reference to FIG. 3, the housing 12 comprises a generally U-shaped lower section 30 and an upper horizontal plate 32 defining a generally central circular aperture 31 therein. Plate 32 is sized to sit upon a portion of the upper wall or the side of the container 18 (FIG. 6) surrounding the casting 16. A pair of V-shaped ribs 38 are mounted on the opposite outer walls 30*a* of the U-shaped lower section 30 of the housing 12 for guiding housing 12 into the cavity in casting 16. A pair of opposed locking jaws 14 are pivotally mounted within the housing 12 at their proximal ends by means of pivot pins 40 secured by rivets or nuts and bolts, not shown. The locking jaws 14 are retractable, their distal ends normally extending upwardly and outwardly from the open ends of U-shaped lower section 30, as viewed in FIG. 3. Locking jaws 14 are generally rectangular in shape defining at their upper outer distal ends a square cut away portion 14*a*. A compression jack spring 42 extends between the lower sections 14*b* of the locking jaws 14 being secured thereto by insertion into opposed cavities 43, 43*a*. To each of connector pins 44*a*, 44*b* mounted on locking jaws 14 are secured the ends 46*a* and 46*b* respectively of a doubled-up release cable 46. The release cable ends 46*a* and 46*b* are guided in opposite directions over a diverter rod 48 secured by means of a cotter pin 50 (FIG. 4). The cable ends 46*a* and 46*b* are suitably tensioned by means of compression spring 42 and the doubled-up cable 46 fed through a bore 56 defined in the pivot pin 22 which extends through aperture 31 of the housing top plate 32. The cable ends 46*a* and 46*b* are crimped to convertor pins 44*a*, 44*b* respectively as shown in FIG. 3 forming the unitary release cable 46, the operation of which being described hereinafter.

Figure 6:
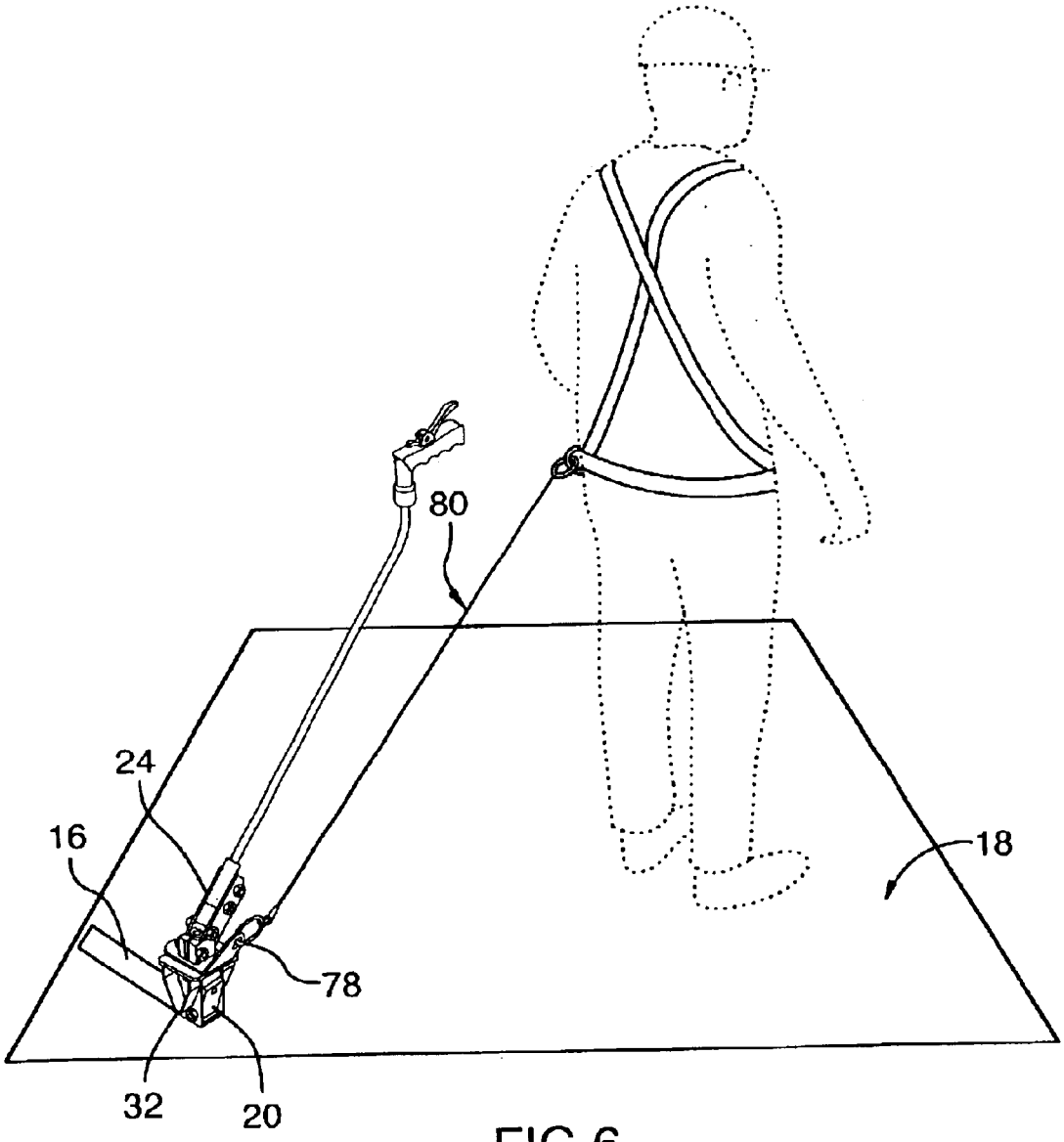
FIG. 6 is a perspective view of the anchoring device of FIG. 1 depicting the device in its operating position secured in a container casting in combination with the shock-absorbing lanyard secured to a personal full body harness.

As stated earlier, the vertical pivot pin 22 defines an internal bore 56, forming at its lower end a circumferential flange 58 abutting the underside of plate 32. Above the housing top plate 32 is mounted the oval anchor plate 20 which defines an upwardly extending lip 20*a* having a generally central circular aperture 36 defined therein. The aperture 36 is adapted to receive a carabiner 78 or the like to which may be attached the retractable shock-absorbing lanyard 80 or safety line (FIG. 6).

Figure 2:
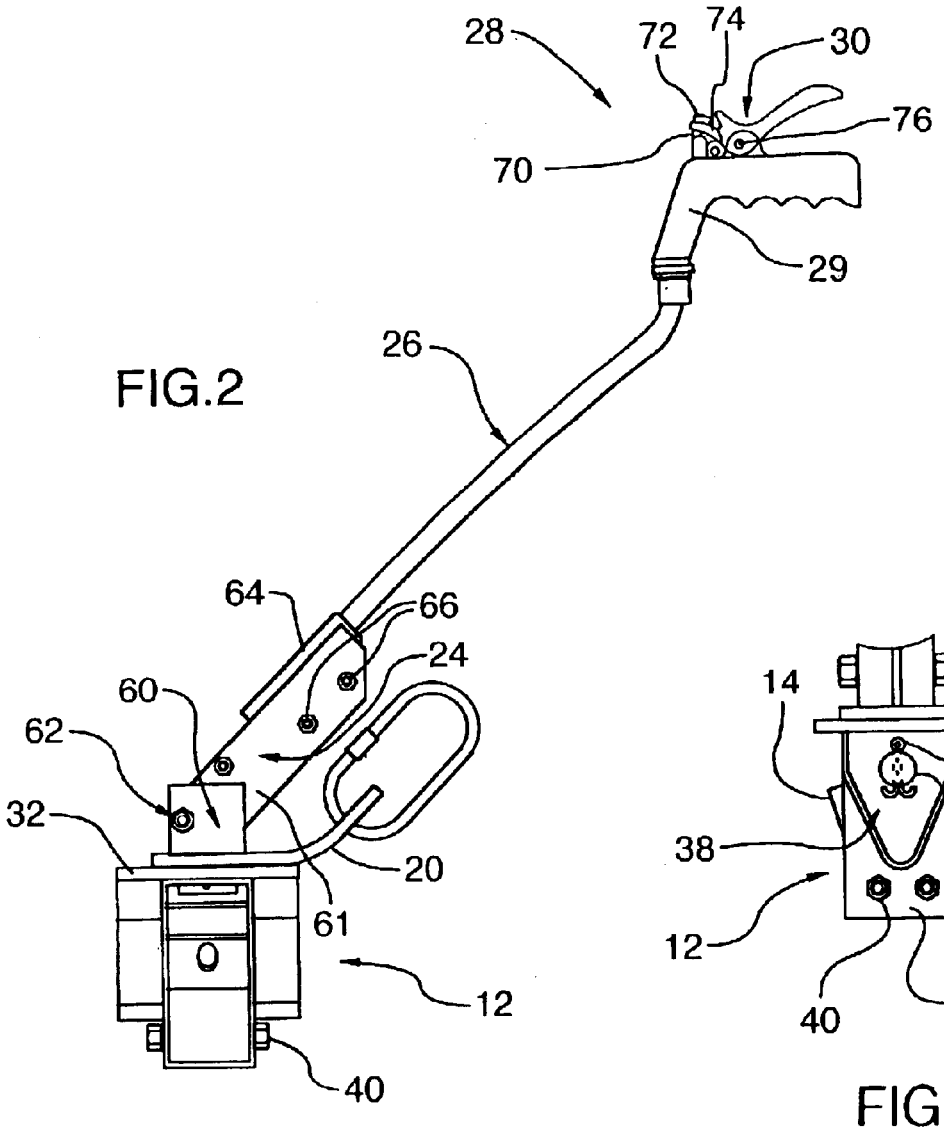
FIG. 2 is a side elevation view of the anchoring device of FIG. 1.

A pair of opposed rectangular plates 60 (FIG. 2) are provided on each side of the vertical pivot pin 22 being secured one to another by means of a nut and bolt assembly 62. The handle socket 24, sized to fit into plates 60 at an angle thereto, comprises a pair of opposed plates 61 having a sleeve 64 secured there between by means of nut and bolt assemblies 66. The release cable 46 extending vertically through the bore of pivot pin 22 is guided over a cable guide roller 68 upwardly through sleeve 64 and into the shaft 26 connected thereto. The shaft 26 extends angularly upwardly to the handle and locking jaw actuator assembly 28.

Figure 5:
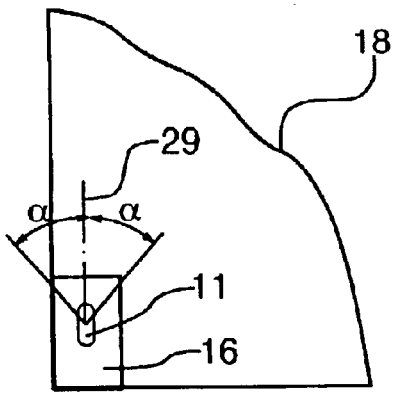
FIG. 5 is a plan view depicting the angle of travel of the handle assembly of the anchoring device of FIG. 1.

As illustrated in FIG. 5, pivot pin 22 is functional to permit rotation of the handle socket 24, shaft 26 and handle assembly 28 through an angle $\alpha$ of about 45 degrees on each side of the centre of the horizontal axis 29 of the casting 16.

The handle and locking jaw actuator assembly 28 (FIGS. 1 and 2) are made up as follows. To the shaft 26 is secured an industrial grip 29, the grip 29 having a trigger 67 which is pivotally mounted on the grip 29 in a pair of opposed tabs 31 formed on grip 29 and secured by means of rivets or a nut and bolt assembly 76. Trigger 67 is functional upon depression thereof for retraction of cable 46 to retract the locking jaws 14 inwardly towards each other, thus enabling the anchoring device 10 to be detached from the casting 16. More specifically, the doubled-up release cable 46 is attached to the lower end of nylon piston 70 extending internally through the grip 29. The piston 70 passes through an extension 74 formed at the distal end of the hand actuated trigger 67. The top of the piston 70 receives locking nut 72 which engages trigger extension 74 to enable lifting and extension of the release cable 46.

In operation, the anchoring device 10 is guided downwardly or sideways into a cavity 11 receptacle of a casting 16 whereby the projecting ends of spring-loaded jaws 14 are depressed towards each other into housing 12 for outwardly snap-engagement with the underside of lip 100 of casting 16 (FIG. 3), thereby locking anchoring device 10 into casting 16. The user is attached to housing 12 by a lanyard 80 secured thereto by carabiner 78. The user can quickly detach the anchoring device 10 from castings 16 by squeezing the trigger 67 as the distal ends of shaft 26 to extend cable 46 outwardly from handle assembly 28, thereby retracting normally outwardly-biased jaws 14 inwardly for release from casting lips 100. Handle 28 or shaft 26 can be pivoted through 90° of arc for convenience of access to the user.

The anchoring device of the invention provides a safety anchor for personnel moving and working on stacked containers or on heaving ship decks. The anchoring device can be quickly guided and easily snapped into engagement with the castings and receptacles present on containers and ship decks and readily detached from the castings when desired by the user.

It will be understood, of course, that modifications can be made in the embodiments of the invention described herein without departing from the scope and purview of the invention as defined by the appended claims.

I claim:

1. An anchoring device adapted for releasable locking engagement within a casting, said anchoring device being adapted for use with personnel safety securing assemblies which comprises:

a housing forming a lower section having a pair of opposed spring-loaded releasable locking jaws associated therewith, said locking jaws further having a release cable secured thereto and being functional to extend into locking engagement within said receptacle, said housing forming an upper plate sized to seat against said receptacle;

a pivot pin, extending from within said housing through the upper plate to a distance thereabove;

a handle assembly forming a stem, said handle assembly being operatively connected to said pivot pin whereby said stem may be rotated about the receptacle to an angle of up to about 45 degrees on each side thereof, said handle assembly further defining a central bore whereby said release cable may extend therethrough for operative engagement with a trigger provided on said handle assembly whereby actuation of the trigger functions to release said locking jaws from within said receptacle.

2. An anchoring device as claimed in claim 1, wherein said housing has a U-shaped lower section and in which said spring-loaded releasable locking jaws comprise a pair of opposed jaws pivotally-mounted at their lower ends in said U-shaped housing whereby upper ends of the jaws project outwardly from the U-shaped lower section for locking engagement with the receptacle.

3. An anchoring device as claimed in claim 2, in which a compression spring operatively positioned between the locking jaws biases said locking jaws apart for normally spring loading of the jaws away from each other.

* * * * *